United States Patent [19]

Kurschner

[11] Patent Number: 4,569,538

[45] Date of Patent: Feb. 11, 1986

[54] BOOKMARK

[76] Inventor: Lloyd F. Kurschner, 523 8th Ave. NE., Minneapolis, Minn. 55413

[21] Appl. No.: 564,752

[22] Filed: Dec. 22, 1983

Related U.S. Application Data

[63] Continuation of Ser. No. 293,396, Aug. 17, 1981, abandoned.

[51] Int. Cl.[4] ..... B42D 9/00

[52] U.S. Cl. ..... 281/42; 116/235; 116/237

[58] Field of Search ..... 281/42; 116/233, 234, 116/235, 237, 238, 239

[56] References Cited

U.S. PATENT DOCUMENTS

| | | | |
|---|---|---|---|
| 1,809,943 | 6/1931 | Ockenden | 116/239 |
| 1,966,340 | 7/1934 | Forbringer et al. | 116/235 |
| 2,001,650 | 5/1935 | Bane | 116/235 |
| 2,260,069 | 10/1941 | Whitson | 116/237 |
| 2,394,372 | 2/1946 | Evans | 281/42 |
| 2,576,783 | 11/1951 | Dewey | 281/42 |
| 2,645,197 | 7/1953 | Jones et al. | 116/238 |
| 2,853,043 | 9/1958 | Bitterman et al. | 116/234 |
| 3,381,654 | 5/1968 | Happ et al. | 116/237 |
| 4,335,903 | 6/1982 | Collins et al. | 281/42 |

FOREIGN PATENT DOCUMENTS

| | | | |
|---|---|---|---|
| 624883 | 7/1936 | Fed. Rep. of Germany | 116/239 |
| 2931263 | 2/1981 | Fed. Rep. of Germany | 116/234 |

*Primary Examiner*—Paul A. Bell
*Assistant Examiner*—Paul M. Heyrana, Sr.
*Attorney, Agent, or Firm*—John W. Adams

[57] ABSTRACT

A bookmark with a retaining hook element at the top thereof to receive the upper end of the bound edge of a book and positively prevent the bookmark from shifting longitudinally and laterally of said bound edge. In one form, the bookmark is provided with a plurality of reference indicia slits along opposite edges of an elongated body and includes a plurality of elongated cord elements adapted to be inserted into one or more of said indicia slits along the edges of the body to provide reference indicia for the subject matter of the book.

16 Claims, 3 Drawing Figures

BOOKMARK

This is a continuation of application Ser. No. 293,396 filed 8/17/81 now abandoned.

BACKGROUND OF THE INVENTION

A great many bookmarks have been developed over the years; however, one of the problems has been that the bookmark will slide down into the book and be difficult to locate or will fall out entirely. This problem occurs not only when the bookmark is being used in its marking function but is also a problem when the user is reading the book and merely wants to insert the bookmark between the pages for storage purposes while the book is in use. None of the prior art provides a retaining hook element at the upper end of the bookmark which receives the upper end of the bound edge of the book and positively maintains the upper portion of the mark in upwardly extended position above the top edge of the book for ready access. By preventing the bookmark from sliding down between the pages, the bookmark will always be accessible. Also a number of different page referencing concepts have been used in the past; however, none of these concepts provide a highly versatile referencing system such as the present invention.

SUMMARY OF THE INVENTION

The present invention provides a single unitary bookmark member made from thin, yet relatively stiff and durable material cut in a configuration to provide a hook element at the top thereof to receive the upper end of the bound edge of a book and retain the bookmark in visible, accessible position above the upper end of the book to facilitate access thereto. The hook element provides two anchoring functions; the first is to positively prevent the bookmark from sliding down in between the pages of a book and the second is to hold the mark laterally to positively maintain the bookmark in engagement with the bound edge of the book and prevent the mark from falling out of the book. This bookmark is formed with an elongated body portion extended downwardly from the anchoring hook. In one form, the body may be provided with spaced indicia referencing slits along the edges thereof and has a plurality of elongated, relatively thin cord elements anchored to the upper end of said body but having a main length thereof free for selective insertion into said referencing slits to provide quick and easy reference to selected subject matter in the book. The bookmark is particularly adapted for use as a Bible referencing indicator and the indicia slits are specifically provided to facilitate such referencing. By maintaining the upper end of the bookmark above the top edge of the book, an indexing tab is provided on which the indexed reference may be visibly displayed. This facilitates the use of a number of different bookmarks and indexed references.

DETAILED DESCRIPTION PREFERRED EMBODIMENT

Figure 1:
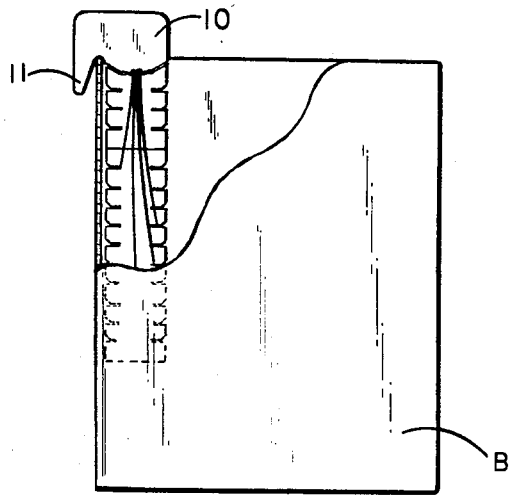
FIG. 1 is a a front elevational view of one form of my bookmark positioned in a book.
Figure 3:
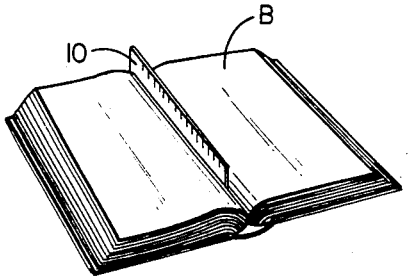
FIG. 3 is a perspective view of the form of my bookmark shown in FIG. 1.

A book such as a Bible is illustrated in FIG. 1 and is designated by the letter B. The invention includes a bookmark made from flat, durable sheet material having an elongated body 10 with a hook element 11 formed at the top thereof. The hook element defines a hook opening 11*a*.

Figure 2:
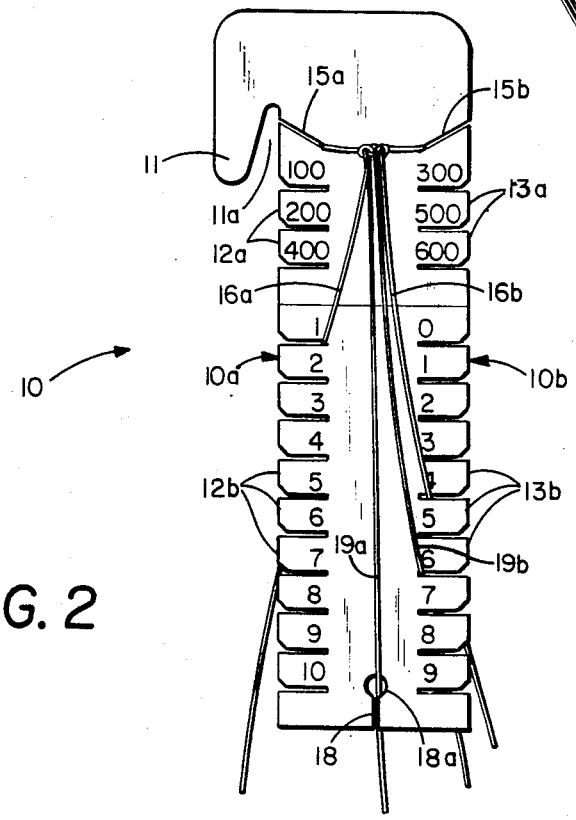
FIG. 2 is a front elevational view of a modified form of the invention.

FIG. 2 illustrates another form of the invention which includes referencing indicia. In this form the portion of the body 10 disposed below the hook 11 has a plurality of space-apart slits formed therein along both longitudinal edges 10*a* and 10*b*. The slits formed along the edge 10*a* are designated 12*a* and 12*b*, and the slits formed along the edge 10*b* are designated 13*a* and 13*b*. In the form shown, each of the slits 12*a* and *b*, and 13*a* and *b* have a lead-in bevel to facilitate insertion of the cords.

A pair of cord-anchoring slits 15*a* and 15*b* are respectively formed in the upper portion of the body 10 and are sloped downwardly and inwardly from the two edges 10*a* and 10*b* of the body above the upper slits 12*a* and 13*a*. The anchoring slits 15*a* and 15*b* are provided to anchor an intermediate portion of a cord to the body. A pair of indicia referencing cord lengths 16*a* and 16*b* are formed by a single length of cord having an intermediate portion inserted into the slits 15*a* and 15*b* which are sloped downwardly as shown. The cord is wrapped around the portion of the body disposed between said slits and the lengths 16*a* and *b* may be tied together as shown. A second pair of cord lengths 19*a* and 19*b*, of a different color, may be anchored in the slits 15*a* and 15*b* and the different colors may be used respectively to reference chapters and verses of the Bible.

When not in use, the cord lengths 16*a* and 16*b* may be inserted in a retaining slit 18 formed in the lower end of the body 10 as illustrated. A hole 18*a* is provided at the top of slit 18. This hole serves two functions. It permits an individual cord to be readily selected and removed from the slit 18 by spreading out the cords and it also prevents the slit 18 from tearing.

If the bookmark is being used with a Bible, the two strands 16*a* and 16*b* which are one color, such as black, may be used to reference chapters and the strands 19*a* and 19*b* which are red, may be used to indicate the verse references. Each of the slits 12*a* and *b* and 13*a* and *b* is provided with a referencing indicia number. The upper slits 12*a* and 13*a* are provided for large reference indicia numbers such as 100 through 600, as shown.

EXAMPLE 1

If a Bible reference was John 14:6, one of the two black strands would be inserted into number "1" of the lower slits 12*b* which represents the "10's" digits. The other black strand would be inserted into slit number "4" of scale 12*b* which represents the unit numbers. One of the red strands would be inserted into slit number "6" on slits 13*b*.

EXAMPLE 2

If the bookmark was being used to indicate a page reference in a large volume, such as page number 1125, the two black strands could be inserted into the slits marked "500" and "600" of the upper slits 13*a* and one red strand could be inserted into the number "2" of slits 12*b* indicating "20" and the other red strand could be inserted in the "5" slit for slits 13*b*, thus totalling 1125.

It should be pointed out that the hook opening 11*a* diminishes toward its upper closed end to provide a wedging action with the upper end of the bound edge of the book. This tends to anchor the bookmark in place and serves to positively prevent the bookmark from shifting laterally away from the bound edge of the book and, of course, positively prevents the bookmark from sliding down into the book. The hook element also maintains a visible tab area above the upper end of the hook which may be used to write identifying data if desired.

What is claimed is:

1. A bookmark comprising, an elongated body member made from thin sheet material and having top, bottom and longitundial edges and adapted to be interposed between selected pages of a book, said bookmark including a plurality of spaced-apart reference indicia slits along at least one of the longitudinal edges of the body thereof with each slit having an indicating reference number, and a plurality of cord elements anchored at the top of said body at an intermediate portion thereof to provide two reference indicating elements adapted to be selectively received in one or more of the slits formed along the sides of said body.

2. The structure set forth in claim 1 and, said slits having a lead-in bevelled portion to facilitate insertion of the cord into the selected slit.

3. The structure set forth in claim 1 and, cord anchoring means formed in the upper portion of said body and constituting, a pair of slits disposed above the reference slits and sloping inwardly and downwardly from the edges, the intermediate portion of at least one cord positively anchored to the upper portion of the body by being inserted into said top pair of slits and wrapped around the adjacent body portion disposed between said top slits.

4. The structure set forth in claim 1 and, a storage slit formed at the lower end of said body to hold any of said cord elements which are not in use by being inserted into the reference indicia slits formed along the edges of the body member.

5. The structure set forth in claim 4 and, the body having a cord receiving hole at the upper end of said storage slit to hold the unused cord elements while also facilitating removal thereof for use.

6. The structure set forth in claim 1 wherein said slits are formed along both longitudinal edges and a retaining hook element is formed in laterally offset relation to the upper portion of one longitudinal edge of the body and defining a downwardly disposed hook opening adapted to be received around the upper end of the bound edge of a book when the one longitudinal edge is received in marking position between pages of the book adjacent the inside bound edge thereof to maintain a portion of the bookmark above the upper edge of the book and facilitate easy access thereto.

7. The structure set forth in claim 6 and said slits having a lead-in bevelled portion to facilitate insertion of the cord into the selected slit.

8. The structure set forth in claim 6 and cord anchoring means formed in the upper portion of said body and constituting, a pair of slits disposed above the reference slits and sloping inwardly and downwardly from the edges, the intermediate portion of at least one cord positively anchored to the upper portion of the body by being inserted into said top pair of slits and wrapped around the adjacent body portion disposed between said top slits.

9. The structure set forth in claim 6 and a storage slit formed at the lower end of said body to hold any of said cord elements which are not in use by being inserted into the reference indicia slits formed along the edges of the body member.

10. The structure set forth in claim 9 and the body having a cord receiving hole at the upper end of said storage slit to hold the unused cord elements while also facilitating removal thereof for use.

11. The structure set forth in claim 1 and a retaining hook element formed in laterally offset relation to the upper portion of one longitudinal edge of the body and defining a downwardly disposed hook opening adapted to be received around the upper end of the bound edge of a book when the one longitudinal edge is received in marking position between pages of the book adjacent the inside bound edge thereof to maintain a portion of the bookmark above the upper edge of the book and facilitate easy access thereto.

12. The structure set forth in claim 11 and said slits having a lead-in bevelled portion to facilitate insertion of the cord into the selected slit.

13. The structure set forth in claim 11 and cord anchoring means formed in the upper portion of said body and constituting, a pair of slits disposed above the reference slits and sloping inwardly and downwardly from the edges, the intermediate portion of at least one cord positively anchored to the upper portion of the body by being inserted into said top pair of slits and wrapped around the adjacent body portion disposed between said top slits.

14. The structure set forth in claim 11 and a storage slit formed at the lower end of said body to hold any of said cord elements which are not in use by being inserted into the reference indicia slits formed along the edges of the body member.

15. The structure set forth in claim 14 and the body having a cord receiving hole at the upper end of said storage slit to hold the unused cord elements while also facilitating removal thereto for use.

16. The structure set forth in claim 1 and said plurality of spaced-apart reference indicia slits being formed along both longitudinal edges of the body.

* * * * *